US010087713B2

(12) United States Patent
Grubert

(10) Patent No.: US 10,087,713 B2
(45) Date of Patent: Oct. 2, 2018

(54) INTERNAL SUBSURFACE SAFETY VALVE FOR ROTATING DOWNHOLE PUMPS

(71) Applicant: Marcel A. Grubert, Montgomery, TX (US)

(72) Inventor: Marcel A. Grubert, Montgomery, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 284 days.

(21) Appl. No.: 14/827,518

(22) Filed: Aug. 17, 2015

(65) Prior Publication Data

US 2016/0097258 A1 Apr. 7, 2016

Related U.S. Application Data

(60) Provisional application No. 62/058,448, filed on Oct. 1, 2014.

(51) Int. Cl.

| | |
|---|---|
| ***E21B 34/14*** | (2006.01) |
| ***E21B 43/12*** | (2006.01) |
| ***E21B 33/126*** | (2006.01) |
| ***E21B 34/10*** | (2006.01) |

(52) U.S. Cl.

CPC ..... *E21B 34/14* (2013.01); *E21B 33/126* (2013.01); *E21B 34/10* (2013.01); *E21B 43/126* (2013.01)

(58) Field of Classification Search

CPC ..... E21B 33/126; E21B 34/10; E21B 34/14; E21B 43/126; E21B 33/1275

See application file for complete search history.

(56) References Cited

U.S. PATENT DOCUMENTS 2,345,710 A * 4/1944 Lybyer ..... F04B 53/00 166/105.1
3,066,739 A * 12/1962 Saurenman ..... E21B 33/1275 166/141
3,830,296 A * 8/1974 Shirley ..... E21B 33/124 137/460
3,884,300 A * 5/1975 Garrett ..... E21B 33/12 137/510
4,461,353 A 7/1984 Vinzant et al.
4,478,288 A 10/1984 Bowyer (Continued)

FOREIGN PATENT DOCUMENTS

EP 2 053 196 A1 4/2009
WO WO 2004/092539 A1 10/2004

*Primary Examiner* — James G Sayre

(74) *Attorney, Agent, or Firm* — ExxonMobil Upstream Research Company—Law Department

(57) ABSTRACT

A subsurface safety valve and method for sealing an annulus within a tubular, including a valve housing having a first section having a hollow cylinder for receiving a piston, the hollow cylinder having a first portion, a second portion and a first circumferential ledge; a piston positioned within the hollow cylinder, the piston having a first end, a second end, a first radially extending circumferential land positioned therebetween, and a first reservoir for receiving a first fluid; a biasing element to assist in placing the valve in a sealed condition, the biasing element positioned between the first circumferential ledge of the hollow cylinder and the first radially extending circumferential land; and a flexible sealing member for selectively sealing the annular space when a hydraulic force is exerted thereupon.

38 Claims, 4 Drawing Sheets

(56) References Cited

U.S. PATENT DOCUMENTS

| | | | | |
|---|---|---|---|---|
| 5,305,828 | A * | 4/1994 | White | E21B 33/1294 166/120 |
| 5,551,510 | A * | 9/1996 | Mills | E21B 43/126 166/68 |
| 5,823,265 | A | 10/1998 | Crow et al. | |
| 6,234,247 | B1 | 5/2001 | Head | |
| 6,371,487 | B1 | 4/2002 | Cimbura, Sr. | |
| 6,513,594 | B1 | 2/2003 | McCalvin et al. | |
| 6,595,280 | B2 | 7/2003 | Traylor | |
| 7,195,072 | B2 | 3/2007 | MacKay et al. | |
| 9,085,970 | B2 * | 7/2015 | Xiao | F17D 3/00 |
| 2002/0040788 | A1 | 4/2002 | Hill, Jr. et al. | |
| 2013/0068311 | A1 * | 3/2013 | Xiao | F17D 3/00 137/1 |

* cited by examiner

INTERNAL SUBSURFACE SAFETY VALVE FOR ROTATING DOWNHOLE PUMPS

CROSS-REFERENCE TO RELATED APPLICATION

This application claims the benefit of U.S. Provisional Patent Application 62/058,448, filed Oct. 1, 2014, entitled "Internal Subsurface Safety Valve for Rotating Downhole Pumps," the entirety of which is incorporated by reference herein.

FIELD

The present disclosure is directed generally to artificial lift systems and methods. The present disclosure is also directed generally to a subsurface safety valve for sealing an annulus within a tubular of an artificial lift system.

BACKGROUND

Wells used directly for oil or gas production deliver the oil or gas through tubing positioned within a cased borehole. Production can be assisted by pumping gas into the annulus surrounding the production tubing and passing it through gas lift mandrels into the production tubing. Wells used indirectly for oil or gas production may inject water into the reservoir below the oil layer or pump excess gas back into the reservoir above the oil layer.

Gas lifting is the primary artificial lift method used in offshore oil wells. However, the reservoir draw-downs possible with gas lift are not as high as those that can be achieved with the assistance of pumps. The proper application of pumps can lower the abandonment pressure of wells, increasing reserves captured per well, and reducing the number of wells required to economically deplete an asset. Unfortunately, high-volume oilfield submersible pumping systems are plagued by various issues that reduce their applicability, particularly in high-cost offshore environments and horizontal directionally drilled wells.

Electric submersible pumps (ESPs) or progressive cavity pumps (PCP) are the primary high-volume pumping options available to industry today. ESPs have reliability issues caused by induction motor, seal section, shaft, and power cable failures. The seal section is particularly troublesome, as it is designed to provide a physical barrier between the motor internals and the wellbore fluids. When the seal fails, wellbore fluids can reach the thrust bearings and/or motor, resulting in system failure. ESPs must be specially designed to handle produced gases, which further limits their use. ESPs are commonly installed as part of the tubing string, which means they require a costly pulling rig for installation and replacement.

Modern wells, for safety reasons and regulatory requirements, are typically equipped with subsurface safety valves (SSSV) for offshore applications and other environmentally sensitive areas. Subsurface safety valves are generally designed to be self-closing valves and may be placed down the well, both in the production tubing and the annulus. Subsurface safety valves may be surface controlled and may have springs that fail-safe in the closed position in case of an emergency. Under normal production conditions, they may be kept open by hydraulic fluid pressure.

Motors for supplying the energy to ESP and PCP applications are typically installed in the wellbore, below the position of the SSSV, hence their size is limited, maintenance is difficult and costly, and reliability can be an issue.

As an alternative, specifically for subsea applications, a pump motor installed on top of the wellhead would enable the use of larger motors and be easier to maintain, while providing enhanced artificial lift forces. However, employing a motor on top of the wellhead requires a rotating shaft extending from the wellhead, down the wellbore, to the pump, prohibiting the use of conventionally available subsurface safety valves, since such valves would be unable to close in an emergency.

Therefore, what is needed is a subsurface safety valve that is designed to function with an artificial lift system having a pump motor positioned on top of the wellhead and a rotating shaft extending therefrom, which is effective in sealing the wellbore quickly in an emergency.

SUMMARY

In one aspect, provided is a subsurface safety valve for sealing an annulus within a tubular. The subsurface safety valve includes a valve housing having a first section and a second section, the first section having a hollow cylinder for receiving a piston, the hollow cylinder having a first portion, a second portion and a first circumferential ledge; a piston positioned within the hollow cylinder, the piston having a first end, a second end, a first radially extending circumferential land positioned therebetween, and a first reservoir for receiving a first fluid; a biasing element to assist in placing the valve in a sealed condition, the biasing element positioned between the first circumferential ledge of the hollow cylinder and the first radially extending circumferential land; and a flexible sealing member for selectively sealing the annular space when a hydraulic force is exerted thereupon.

In some embodiments, the piston has at least one orifice for placing the first reservoir in fluid communication with the first portion of the hollow cylinder.

In some embodiments, a second circumferential ledge is positioned between the first portion and the second portion of the hollow cylinder.

In some embodiments, the second portion of the hollow cylinder of the valve housing defines a second reservoir.

In some embodiments, the piston includes a second radially extending circumferential land positioned adjacent the second end of the piston and within the second portion of the hollow cylinder of the valve housing.

In some embodiments, the safety valve is held in an open position by filling the first reservoir of the piston and the first portion of the hollow cylinder of the valve housing with the first fluid and pressurizing the first fluid to a level sufficient to overcome the force exerted by the biasing element.

In some embodiments, the second reservoir contains a second fluid and is structured and arranged to enable the flexible sealing member to be extended into sealing engagement with the tubular upon the urging away of the piston from the first circumferential ledge of the hollow cylinder by the biasing element when the pressure of the first fluid becomes insufficient to overcome the force exerted by the biasing element.

In some embodiments, the flexible sealing member comprises a bladder having a first end and a second end, the first end affixed to the first section of the valve housing and the second end affixed to the second section of the valve housing.

In some embodiments, the flexible sealing member is in the form of an umbrella, the umbrella having a first end affixed to the first section of the valve housing.

In some embodiments, the valve housing is positioned within a section of a rotatable downhole pump shaft.

In some embodiments, the valve housing is positioned within a section of a tubular.

In some embodiments, the subsurface safety valve further includes a conduit having a first end and a second end, the first end in fluid communication with a source of the first fluid and the second end in fluid communication with the first reservoir of the piston.

In some embodiments, the conduit is structured and arranged to delay actuation of the flexible sealing member.

In another aspect, provided is an artificial lift system for use in a subterranean well including a tubular in fluid communication with a reservoir, the tubular extending from a wellhead. The system includes (a) a pump motor, the pump motor positioned above the wellhead; (b) a pump shaft having a first end and a second end, the first end operatively connected to the pump motor; (c) a subsurface safety valve for sealing an annulus within the tubular, the subsurface safety valve positioned between the first end and the second end of the pump shaft and forming a section thereof, the subsurface safety valve comprising (i) a valve housing having a first section and a second section, the first section having a hollow cylinder for receiving a piston, the hollow cylinder having a first portion, a second portion and a first circumferential ledge; (ii) a piston positioned within the hollow cylinder, the piston having a first end, a second end, a first radially extending circumferential land positioned therebetween, and a first reservoir for receiving a first fluid; (iii) a biasing element to assist in placing the valve in a sealed condition, the biasing element positioned between the first circumferential ledge of the hollow cylinder and the first radially extending circumferential land; and (iv) a flexible sealing member for selectively sealing the annular space when a hydraulic force is exerted thereupon.

In some embodiments, the piston has at least one orifice for placing the first reservoir in fluid communication with the first portion of the hollow cylinder.

In some embodiments, a second circumferential ledge is positioned between the first portion and the second portion of the hollow cylinder.

In some embodiments, the second portion of the hollow cylinder of the valve housing defines a second reservoir.

In some embodiments, the piston includes a second radially extending circumferential land positioned adjacent the second end of the piston and within the second portion of the hollow cylinder of the valve housing.

In some embodiments, the safety valve is held in an open position by filling the first reservoir of the piston and the first portion of the hollow cylinder of the valve housing with the first fluid and pressurizing the first fluid to a level sufficient to overcome the force exerted by the biasing element.

In some embodiments, the second reservoir contains a second fluid and is structured and arranged to enable the flexible sealing member to be extended into sealing engagement with the tubular upon the urging away of the piston from the first circumferential ledge of the hollow cylinder by the biasing element when the pressure of the first fluid becomes insufficient to overcome the force exerted by the biasing element.

In some embodiments, the flexible sealing member comprises a bladder having a first end and a second end, the first end affixed to the first section of the valve housing and the second end affixed to the second section of the valve housing.

In some embodiments, the flexible sealing member is in the form of an umbrella, the umbrella having a first end affixed to the first section of the valve housing.

In some embodiments, the artificial lift system further includes a conduit having a first end and a second end, the first end in fluid communication with a source of the first fluid and the second end in fluid communication with the first reservoir of the piston.

In yet another aspect, provided is a method of sealing an annulus within a tubular of an artificial lift well installation. The method includes the step of installing a subsurface safety valve, the subsurface safety valve positioned between the first end and the second end of the pump shaft and forming a section thereof, the subsurface safety valve comprising (i) a valve housing having a first section and a second section, the first section having a hollow cylinder for receiving a piston, the hollow cylinder having a first portion, a second portion and a first circumferential ledge; (ii) a piston positioned within the hollow cylinder, the piston having a first end, a second end, a first radially extending circumferential land positioned therebetween, and a first reservoir for receiving a first fluid; (iii) a biasing element to assist in placing the valve in a sealed condition, the biasing element positioned between the first circumferential ledge of the hollow cylinder and the first radially extending circumferential land; and (iv) a flexible sealing member for selectively sealing the annular space when a hydraulic force is exerted thereupon.

In some embodiments, the piston has at least one orifice for placing the first reservoir in fluid communication with the first portion of the hollow cylinder.

In some embodiments, a second circumferential ledge is positioned between the first portion and the second portion of the hollow cylinder.

In some embodiments, the second portion of the hollow cylinder of the valve housing defines a second reservoir.

In some embodiments, the piston includes a second radially extending circumferential land positioned adjacent the second end of the piston and within the second portion of the hollow cylinder of the valve housing.

In some embodiments, the safety valve is held in an open position by filling the first reservoir of the piston and the first portion of the hollow cylinder of the valve housing with the first fluid and pressurizing the first fluid to a level sufficient to overcome the force exerted by the biasing element.

In some embodiments, the second reservoir contains a second fluid and is structured and arranged to enable the flexible sealing member to be extended into sealing engagement with the tubular upon the urging away of the piston from the first circumferential ledge of the hollow cylinder by the biasing element when the pressure of the first fluid becomes insufficient to overcome the force exerted by the biasing member.

In some embodiments, the flexible sealing member comprises a bladder having a first end and a second end, the first end affixed to the first section of the valve housing and the second end affixed to the second section of the valve housing.

In some embodiments, the flexible sealing member is in the form of an umbrella, the umbrella having a first end affixed to the first section of the valve housing.

In some embodiments, the subsurface safety valve further includes a conduit having a first end and a second end, the first end in fluid communication with a source of the first fluid and the second end in fluid communication with the first reservoir of the piston.

In some embodiments, the valve housing is positioned within a section of a rotatable downhole pump shaft.

In some embodiments, the valve housing is positioned within a section of a tubular.

Also disclosed herein is a method of sealing an annulus within a tubular of an artificial lift well, the artificial lift well comprising a pump motor positioned adjacent the wellhead, the pump motor having a rotatable pump shaft connected thereto and extending into the artificial lift well, the method comprising the steps of terminating the rotation of the rotatable pump shaft; and expanding a flexible sealing member of a subsurface safety valve to seal the annulus about the rotatable pump shaft.

In some embodiments, the step of expanding the flexible sealing member further comprises transferring a predetermined amount of fluid to the flexible sealing member to expand the flexible sealing member.

In some embodiments, the step of transferring the predetermined amount of fluid to the flexible sealing member of the subsurface safety valve further comprises biasing a piston to displace the piston and exert a force sufficient to initiate the transfer of the predetermined amount of fluid.

In some embodiments, the step of terminating the rotation of the rotatable pump shaft further comprises providing a signal to the pump motor responsive to an emergent condition.

In some embodiments, the pump motor includes a control sensor and the step of providing a signal further comprises sensing a reduction in hydraulic pressure.

In some embodiments, the pump motor is located on top of the wellhead.

DETAILED DESCRIPTION

FIGS. 1-4 provide illustrative, non-exclusive examples of subsurface safety valves having utility in connection with other wellbore-related methods and systems, according to the present disclosure of systems, and/or apparatus, and/or assemblies that may include, be associated with, be operatively attached to, and/or utilize such subsurface safety valves. In FIGS. 1-4, like numerals denote like, or similar, structures and/or features; and each of the illustrated structures and/or features may not be discussed in detail herein with reference to FIGS. 1-4. Similarly, each structure and/or feature may not be explicitly labeled in FIGS. 1-4; and any structure and/or feature that is discussed herein with reference to FIGS. 1-4 may be utilized with any other structure and/or feature without departing from the scope of the present disclosure.

In general, structures and/or features that are or are likely to be included in a given embodiment are indicated in solid lines in FIGS. 1-4, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Figure 1:
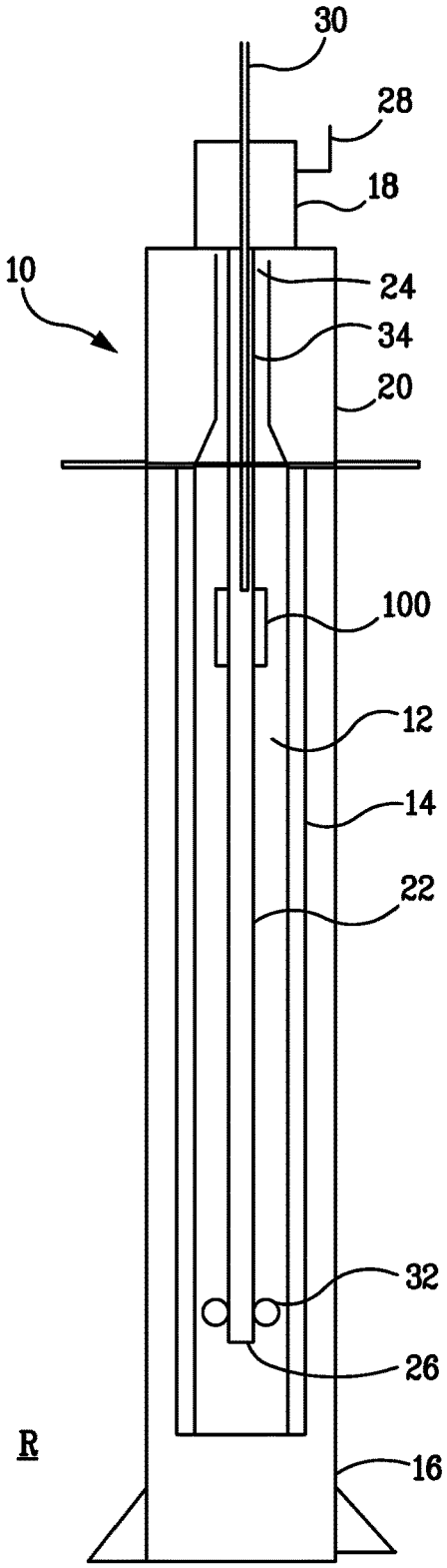
FIG. 1 presents a schematic view of an illustrative, non-exclusive example of an artificial lift system for use in a subterranean well, the artificial lift system including a subsurface safety valve for sealing an annulus within a tubular, according to the present disclosure.

FIG. 1 presents a schematic view of an illustrative, non-exclusive, example of an artificial lift system 10 for use in a subterranean well 16 comprising a tubular 14 in fluid communication with a reservoir R, the tubular 14 extending from a wellhead 20. The system 10 includes a pump motor 18, the pump motor 18 positioned above the wellhead 20. The system 10 further includes a rotating pump shaft 22 having a first end 24 and a second end 26, the first end 24 operatively connected to the pump motor 18. The system 10 further includes a subsurface safety valve 100 for sealing an annulus 12 within the tubular 14, the subsurface safety valve 100 positioned between the first end 24 and the second end 26 of the pump shaft 22, forming a section thereof.

Still referring to FIG. 1, a pump motor control and power lines 28 is provided for powering and controlling pump motor 18. As will be described in more detail below, a hydraulic line 30 is provided, which extends from a control station (not shown) to the pump motor 18. A control sensor (not shown) resides within the pump motor 18, and stops its operation should the pressure in the hydraulic line decrease below a certain threshold value. As recognized by those skilled in the art, this hydraulic mechanism provides an emergency break feature to artificial lift system 10.

As indicated, the rotating shaft 22 reaches down from pump motor 18 into the tubular 14 and, at the second end 26 thereof, a pumping mechanism 32 is provided. Pumping mechanism 32 may be a rotor, a cavity pump assembly, etc., as those skilled in the art would plainly recognize. As will be described in more detail below, installed within the rotating pump shaft 22, at a desired length, is a subsurface safety valve 100. From subsurface safety valve 100, a hydraulic line 34 extends through the rotating pump shaft 22 and leads back to the pump motor 18, where it connects to, and is in fluid communication with, the hydraulic line 30 that extends from the control station to the pump motor 18. As noted, hydraulic line 30 is monitored by the aforementioned control sensor of the pump motor 18.

Figure 2:
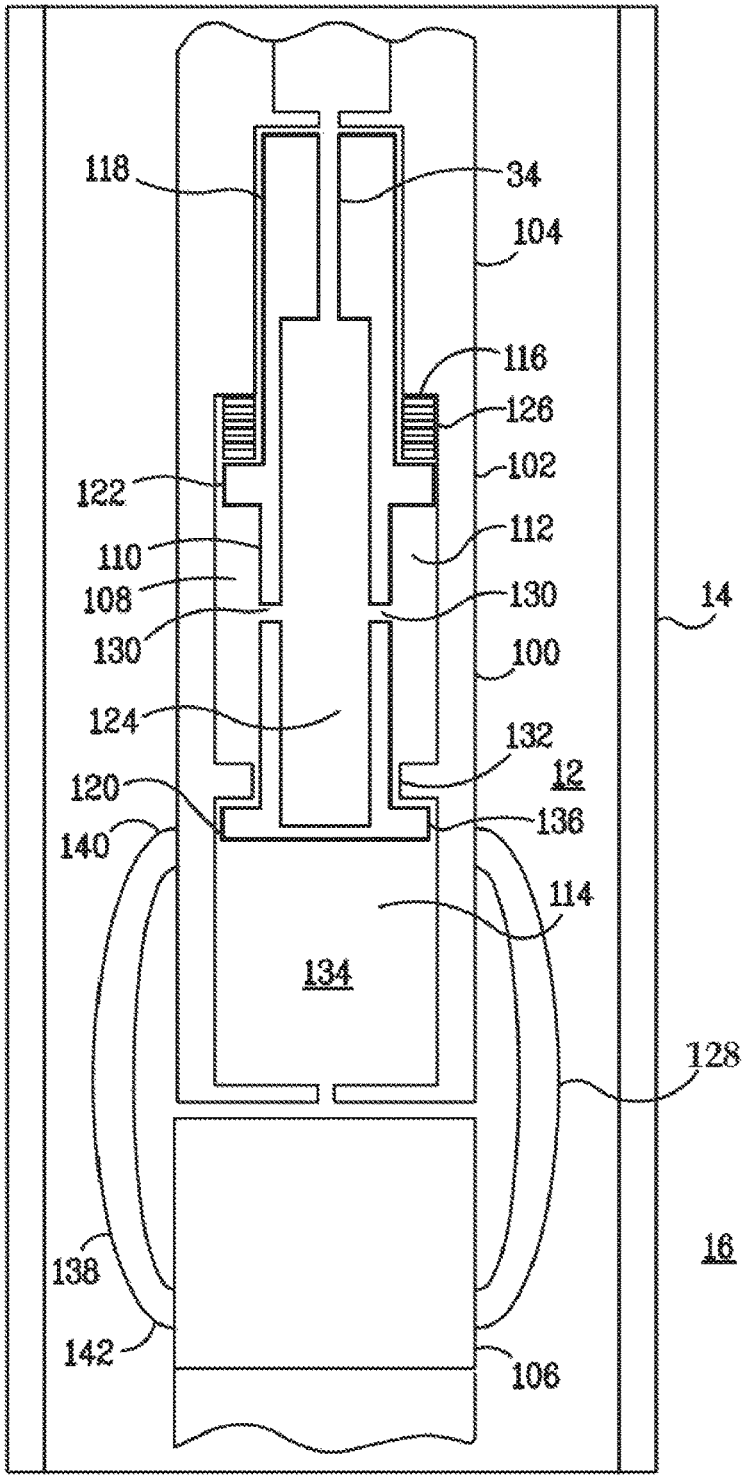
FIG. 2 presents a schematic view of an illustrative, non-exclusive example of a subsurface safety valve for sealing an annulus within a tubular, according to the present disclosure.

Referring now to FIG. 2, a detailed schematic view of an illustrative, non-exclusive example of a subsurface safety valve 100 for sealing an annulus 12 within a tubular 14 is shown. The subsurface safety valve 100 includes a valve housing 102 having a first section 104 and a second section 106. The first section 104 of valve housing 102 includes a hollow cylinder 108 for receiving a piston 110. The hollow cylinder 108 includes a first portion 112, a second portion 114 and a first circumferential ledge 116. A piston 110 is positioned within the hollow cylinder 108. The piston 110 includes a first end 118, a second end 120, a first radially extending circumferential land 122 positioned therebetween, and a first reservoir 124 for receiving a first fluid. A biasing element 126 is employed to assist in placing the valve 100 in a sealed condition, the biasing element 126 positioned between the first circumferential ledge 116 of the hollow cylinder 108 and the first radially extending circumferential land 122. A flexible sealing member 128 is provided for selectively sealing the annular space 12 when a hydraulic force is exerted thereupon.

Still referring to FIG. 2, the piston 110 is provided with at least one orifice 130 for placing the first reservoir 124 in fluid communication with the first portion 112 of the hollow cylinder 108. In some embodiments, a plurality of orifices 130 are provided for placing the first reservoir 124 in fluid communication with the first portion 112 of the hollow cylinder 108.

As shown in the embodiment of FIG. 2, a second circumferential ledge 132 is positioned between the first portion 112 and the second portion 114 of the hollow cylinder 108. In some embodiments, second circumferential ledge 132 serves to delineate the first portion 112 from the second portion 114 of the hollow cylinder 108. Advantageously, the second portion 114 of the hollow cylinder 108 of the valve housing 102 defines a second reservoir 134. In some embodiments, the piston 110 includes a second radially extending circumferential land 136 positioned adjacent the second end 120 of the piston 110 and within the second portion 114 of the hollow cylinder 108 of the valve housing 102.

In normal operation, the subsurface safety valve 100 is held in an open position by filling the first reservoir 124 of the piston 110 and the first portion 112 of the hollow cylinder 108 of the valve housing 102 with the first fluid and pressurizing the first fluid to a level sufficient to overcome the force exerted by the biasing element 126. To address a potential emergency situation, the second reservoir 134 is filled with a second fluid, the second reservoir 134 structured and arranged to enable the flexible sealing member to be filled with displaced fluid from the second reservoir 134 and extended into sealing engagement with the tubular 14 upon the urging away of the piston 110 from the first circumferential ledge 116 of the hollow cylinder 108 by the biasing element 126 when the pressure of the first fluid becomes insufficient to overcome the force exerted by the biasing element 126.

In some embodiments, the flexible sealing member 128 comprises a bladder 138 having a first end 140 and a second end 142, the first end 140 affixed to the first section 104 of the valve housing 102 and the second end 142 affixed to the second section 106 of the valve housing 102. In some embodiments, the hydraulic line 34 (see FIG. 1) is structured and arranged to delay actuation of a flexible sealing member 128.

Figure 3:
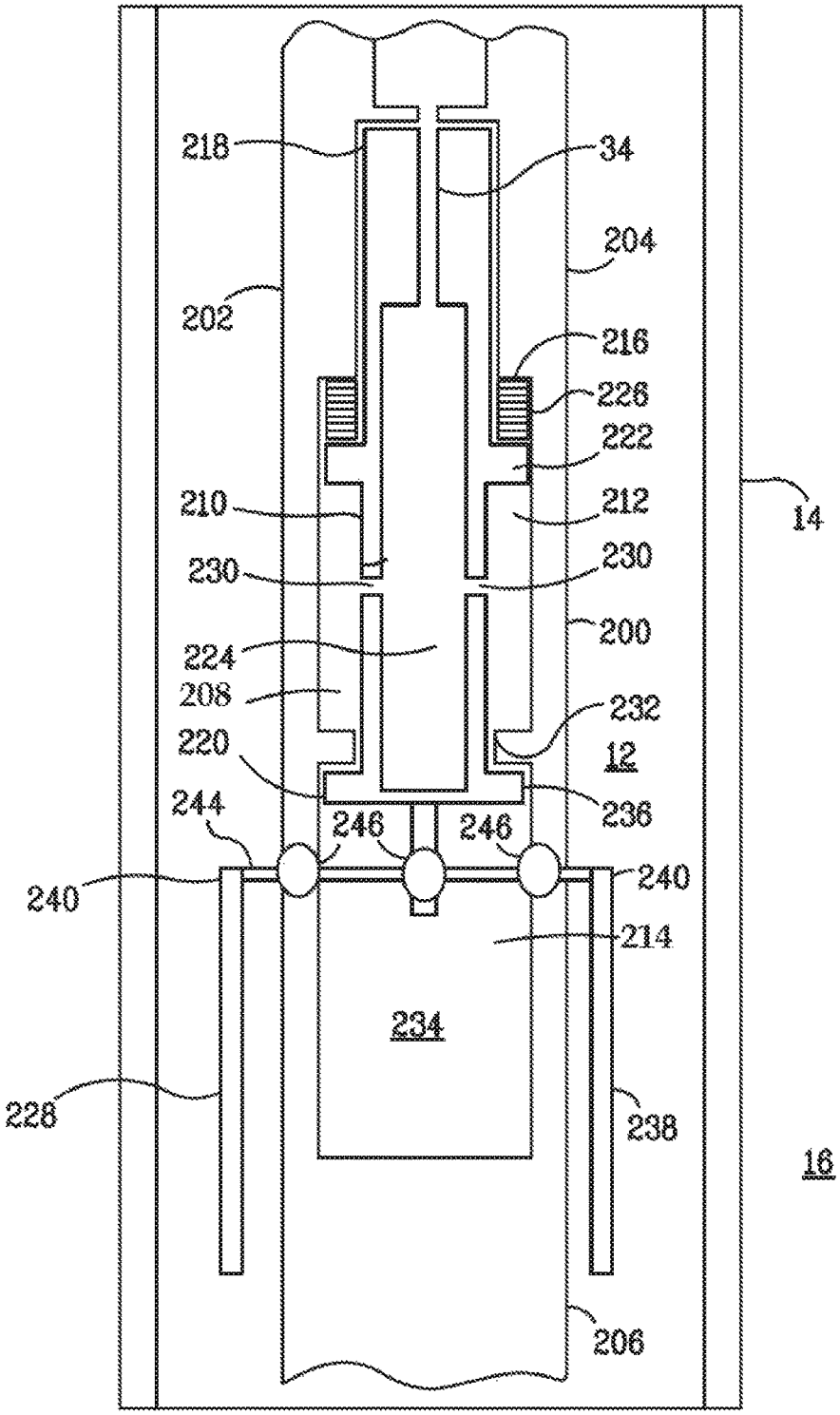
FIG. 3 presents a schematic view of an illustrative, non-exclusive example of another embodiment of a subsurface safety valve for sealing an annulus within a tubular, according to the present disclosure.

Referring now to FIG. 3, a schematic view of an illustrative, non-exclusive example of an alternative embodiment of a subsurface safety valve 200 for sealing an annulus 12 within a tubular 14 is presented. The subsurface safety valve 200 includes a valve housing 202 having a first section 204 and a second section 206. The first section 204 of valve housing 202 includes a hollow cylinder 208 for receiving a piston 210. The hollow cylinder 208 includes a first portion 212, a second portion 214 and a first circumferential ledge 216.

A piston 210 is positioned within the hollow cylinder 208. The piston 210 includes a first end 218, a second end 220, a first radially extending circumferential land 222 positioned therebetween, and a first reservoir 224 for receiving a first fluid. A biasing element 226 is employed to assist in placing the valve 200 in a sealed condition, the biasing element 226 positioned between the first circumferential ledge 216 of the hollow cylinder 208 and the first radially extending circumferential land 222. A flexible sealing member 228 is provided for selectively sealing the annular space 12 when a hydraulic force is exerted thereupon. In the embodiment of FIG. 3, the flexible sealing member 228 is in the form of an umbrella 238, the umbrella having a first end 240 affixed to the first section 204 of the valve housing 202.

Once again referring to FIG. 3, the piston 210 is provided with at least one orifice 230 for placing the first reservoir 224 in fluid communication with the first portion 212 of the hollow cylinder 208. In some embodiments, a plurality of orifices 230 are provided for placing the first reservoir 224 in fluid communication with the first portion 212 of the hollow cylinder 108.

As shown in the embodiment of FIG. 3, a second circumferential ledge 232 is positioned between the first portion 212 and the second portion 214 of the hollow cylinder 208. In some embodiments, second circumferential ledge 232 serves to delineate the first portion 212 from the second portion 214 of the hollow cylinder 208. Advantageously, the second portion 214 of the hollow cylinder 208 of the valve housing 202 defines a second reservoir 234. In some embodiments, the piston 210 includes a second radially extending circumferential land 236 positioned adjacent the second end 220 of the piston 210 and within the second portion 214 of the hollow cylinder 208 of the valve housing 202.

In normal operation, the subsurface safety valve 200 is held in an open position by filling the first reservoir 124 of the piston 210 and the first portion 212 of the hollow cylinder 208 of the valve housing 202 with the first fluid and pressurizing the first fluid to a level sufficient to overcome the force exerted by the biasing element 226.

To address a potential emergency situation, the second reservoir 234 is filled with a second fluid, the second reservoir 234 structured and arranged to enable the flexible sealing member 228 to be pivoted at pivot member 246 when manifold 240 is filled with displaced fluid from the second reservoir 234 and umbrella 238 extended into sealing engagement with the tubular 14 upon the urging away of the piston 210 from the first circumferential ledge 216 of the hollow cylinder 208 by the biasing element 226 when the pressure of the first fluid becomes insufficient to overcome the force exerted by the biasing element 226.

In some embodiments, the hydraulic line 34 (see FIG. 1) is structured and arranged to delay actuation of a flexible sealing member 228.

Figure 4:
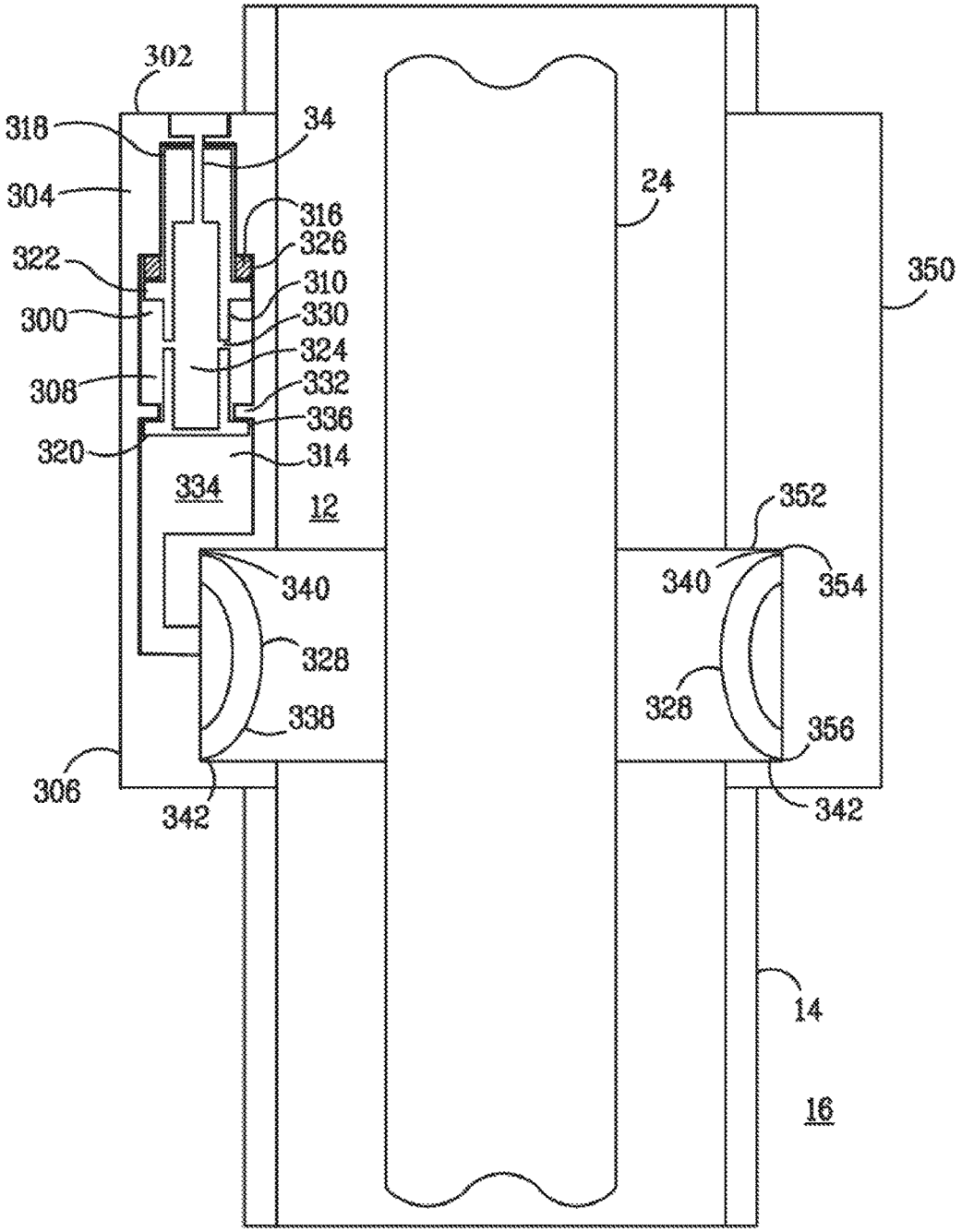
FIG. 4 presents a schematic view of an illustrative, non-exclusive example of another embodiment of a subsurface safety valve for sealing an annulus within a tubular, the subsurface safety valve installed within the tubular, according to the present disclosure.

Referring now to FIG. 4, a schematic view of an illustrative, non-exclusive example of an embodiment of a subsurface safety valve 300 for sealing an annulus 12 within a tubular 14, the subsurface safety valve 300 installed within a tubular section 350 of tubular 14 is shown. The subsurface safety valve 300 includes a valve housing 302 formed within a tubular section 350. Valve housing 302 includes a first section 304 and a second section 306. The first section 304 of valve housing 302 includes a hollow cylinder 308 for receiving a piston 310. The hollow cylinder 308 includes a first portion 312, a second portion 314 and a first circumferential ledge 316.

As in the aforementioned embodiments, a piston 310 is positioned within the hollow cylinder 308. The piston 310 includes a first end 318, a second end 320, and a first radially extending circumferential land 322 positioned therebetween. The piston 310 also includes a first reservoir 324 for receiving a first fluid. A biasing element 326 is employed to assist in placing the valve 300 in a sealed condition. As shown, the biasing element 326 positioned between the first circumferential ledge 316 of the hollow cylinder 308 and the first radially extending circumferential land 322. A flexible sealing member 328 is provided for selectively sealing the annular space 12 when a hydraulic force is exerted thereupon.

Still referring to FIG. 4, the piston 310 is provided with at least one orifice 330 for placing the first reservoir 324 in fluid communication with the first portion 312 of the hollow cylinder 308. In some embodiments, a plurality of orifices 330 are provided for placing the first reservoir 324 in fluid communication with the first portion 312 of the hollow cylinder 308.

As shown in the embodiment of FIG. 4, a second circumferential ledge 332 is positioned between the first portion 312 and the second portion 314 of the hollow cylinder 308. In some embodiments, second circumferential ledge 332 serves to delineate the first portion 312 from the second portion 314 of the hollow cylinder 308. Advantageously, the second portion 314 of the hollow cylinder 308 of the valve housing 302 defines a second reservoir 334. In some embodiments, the piston 310 includes a second radially extending circumferential land 336 positioned adjacent the second end 320 of the piston 310 and within the second portion 314 of the hollow cylinder 308 of the valve housing 302.

In normal operation, the subsurface safety valve 300 is held in an open position by filling the first reservoir 324 of the piston 310 and the first portion 312 of the hollow cylinder 308 of the valve housing 302 with the first fluid and pressurizing the first fluid to a level sufficient to overcome the force exerted by the biasing element 326. To address a potential emergency situation, the second reservoir 334 is filled with a second fluid, the second reservoir 334 structured and arranged to enable the flexible sealing member 328 to be filled with displaced fluid from the second reservoir 334 and extended into sealing engagement with the pump shaft 24 upon the urging away of the piston 310 from the first circumferential ledge 316 of the hollow cylinder 308 by the biasing element 326 when the pressure of the first fluid becomes insufficient to overcome the force exerted by the biasing element 326.

In some embodiments, the flexible sealing member 328 comprises a bladder 338 having a first end 340 and a second end 342, the first end 340 affixed to an upper portion 354 of annular section 352 of tubular section 350 and the second end 342 affixed to an lower portion 356 of annular section 352 of tubular section 350. In some embodiments, the hydraulic line 34 (see FIG. 1) is structured and arranged to delay actuation of a flexible sealing member 328.

As may be appreciated, the various forms of the subsurface safety valves disclosed herein may be used in to ensure the safety of an artificial lift well installation. As such, disclosed herein is a method that includes the step of installing a subsurface safety valve for sealing an annulus within a tubular, the subsurface safety valve positioned between the first end and the second end of a pump shaft and forming a section thereof. The subsurface safety valve includes a valve housing having a first section and a second section, the first section having a hollow cylinder for receiving a piston, the hollow cylinder having a first portion, a second portion and a first circumferential ledge; a piston positioned within the hollow cylinder, the piston having a first end, a second end, a first radially extending circumferential land positioned therebetween, and a first reservoir for receiving a first fluid; a biasing element to assist in placing the valve in a sealed condition, the biasing element positioned between the first circumferential ledge of the hollow cylinder and the first radially extending circumferential land; and a flexible sealing member for selectively sealing the annular space when a hydraulic force is exerted thereupon.

Also disclosed herein is a method that includes the step of installing a subsurface safety valve for sealing an annulus within a tubular, the subsurface safety valve positioned within a tubular section of the tubular. The subsurface safety valve includes a valve housing having a first section and a second section, the first section having a hollow cylinder for receiving a piston, the hollow cylinder having a first portion, a second portion and a first circumferential ledge; a piston positioned within the hollow cylinder, the piston having a first end, a second end, a first radially extending circumferential land positioned therebetween, and a first reservoir for receiving a first fluid; a biasing element to assist in placing the valve in a sealed condition, the biasing element positioned between the first circumferential ledge of the hollow cylinder and the first radially extending circumferential land; and a flexible sealing member for selectively sealing the annular space when a hydraulic force is exerted thereupon.

Also disclosed herein is a method of sealing an annulus within a tubular of an artificial lift well, the artificial lift well comprising a pump motor positioned adjacent the wellhead, the pump motor having a rotatable pump shaft connected thereto and extending into the artificial lift well, the method comprising the steps of terminating the rotation of the rotatable pump shaft; and expanding a flexible sealing member of a subsurface safety valve to seal the annulus about the rotatable pump shaft.

In some embodiments, the step of expanding the flexible sealing member further comprises transferring a predetermined amount of fluid to the flexible sealing member to expand the flexible sealing member.

In some embodiments, the step of transferring the predetermined amount of fluid to the flexible sealing member of the subsurface safety valve further comprises biasing a piston to displace the piston and exert a force sufficient to initiate the transfer of the predetermined amount of fluid.

In some embodiments, the step of terminating the rotation of the rotatable pump shaft further comprises providing a signal to the pump motor responsive to an emergent condition.

In some embodiments, the pump motor includes a control sensor and the step of providing a signal further comprises sensing a reduction in hydraulic pressure.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure have been presented. It is within the scope of the present disclosure that an individual step of a method recited herein may additionally or alternatively be referred to as a "step for" performing the recited action.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

I claim:

1. A subsurface safety valve for sealing an annulus within a tubular, comprising:

a valve housing having a first section and a second section, the first section having a hollow cylinder for receiving a piston, the hollow cylinder having a first portion, a second portion and a first circumferential ledge;

a piston positioned within the hollow cylinder, the piston having a first end, a second end, a first radially extending circumferential land positioned therebetween, and a first reservoir for receiving a first fluid;

a biasing element to assist in placing the valve in a sealed condition, the biasing element positioned between the first circumferential ledge of the hollow cylinder and the first radially extending circumferential land; and an annulus sealing member for selectively sealing the annulus space when a hydraulic force is exerted thereupon.

2. The subsurface safety valve of claim 1, wherein the piston has at least one orifice for placing the first reservoir in fluid communication with the first portion of the hollow cylinder.

3. The subsurface safety valve of claim 2, wherein a second circumferential ledge is positioned between the first portion and the second portion of the hollow cylinder.

4. The subsurface safety valve of claim 3, wherein the second portion of the hollow cylinder of the valve housing defines a second reservoir.

5. The subsurface safety valve of claim 4, wherein the piston includes a second radially extending circumferential land positioned adjacent the second end of the piston and within the second portion of the hollow cylinder of the valve housing.

6. The subsurface safety valve of claim 5, wherein the safety valve is held in an open position by filling the first reservoir of the piston and the first portion of the hollow cylinder of the valve housing with the first fluid and pressurizing the first fluid to a level sufficient to overcome the force exerted by the biasing element.

7. The subsurface safety valve of claim 6, wherein the second reservoir contains a second fluid and is structured and arranged to enable the sealing member to be extended into sealing engagement with the tubular upon the urging away of the piston from the first circumferential ledge of the hollow cylinder by the biasing element when the pressure of the first fluid upon the piston becomes insufficient to overcome the force exerted upon the piston by the biasing element.

8. The subsurface safety valve of claim 7, wherein the sealing member comprises a bladder having a first end and a second end, the first end affixed to the first section of the valve housing and the second end affixed to the second section of the valve housing.

9. The subsurface safety valve of claim 7, wherein the sealing member is in the form of an umbrella, the umbrella having a first end affixed to the first section of the valve housing.

10. The subsurface safety valve of claim 7, wherein the valve housing is positioned within a section of a rotatable downhole pump shaft.

11. The subsurface safety valve of claim 7, wherein the valve housing is positioned within a section of a tubular.

12. The subsurface safety valve of claim 7, further comprising a conduit having a first end and a second end, the first end in fluid communication with a source of the first fluid and the second end in fluid communication with the first reservoir of the piston.

13. The subsurface safety valve of claim 7, wherein the conduit is structured and arranged to delay actuation of the sealing member.

14. An artificial lift system for use in a subterranean well comprising a tubular in fluid communication with a reservoir, the tubular extending from a wellhead, the system comprising:

(a) a pump motor, the pump motor positioned above the wellhead;

(b) a pump shaft having a first end and a second end, the first end operatively connected to the pump motor;

(c) a subsurface safety valve for sealing an annulus space within the tubular, the subsurface safety valve positioned between the first end and the second end of the pump shaft and forming a section thereof, the subsurface safety valve comprising (i) a valve housing having a first section and a second section, the first section having a hollow cylinder for receiving a piston, the hollow cylinder having a first portion, a second portion and a first circumferential ledge; (ii) a piston positioned within the hollow cylinder, the piston having a first end, a second end, a first radially extending circumferential land positioned therebetween, and a first reservoir for receiving a first fluid; (iii) a biasing element to assist in placing the valve in a sealed condition, the biasing element positioned between the first circumferential ledge of the hollow cylinder and the first radially extending circumferential land; and (iv) a sealing member for selectively sealing the annulus space when a hydraulic force is exerted thereupon.

15. The artificial lift system of claim 14, wherein the piston has at least one orifice for placing the first reservoir in fluid communication with the first portion of the hollow cylinder.

16. The artificial lift system of claim 15, wherein a second circumferential ledge is positioned between the first portion and the second portion of the hollow cylinder.

17. The artificial lift system of claim 16, wherein the second portion of the hollow cylinder of the valve housing defines a second reservoir.

18. The artificial lift system of claim 17, wherein the piston includes a second radially extending circumferential land positioned adjacent the second end of the piston and within the second portion of the hollow cylinder of the valve housing.

19. The artificial lift system of claim 18, wherein the safety valve is held in an open position by filling the first reservoir of the piston and the first portion of the hollow cylinder of the valve housing with the first fluid and pressurizing the first fluid to a level sufficient to overcome the force exerted by the biasing element.

20. The artificial lift system of claim 19, wherein the second reservoir contains a second fluid and is structured and arranged to enable the sealing member to be extended into sealing engagement with the tubular upon the urging away of the piston from the first circumferential ledge of the hollow cylinder by the biasing element when the pressure of the first fluid becomes insufficient to overcome the force exerted by the biasing element.

21. The artificial lift system of claim 20, wherein the sealing member comprises a bladder having a first end and a second end, the first end affixed to the first section of the valve housing and the second end affixed to the second section of the valve housing.

22. The artificial lift system of claim 20, wherein the sealing member is in the form of an umbrella, the umbrella having a first end affixed to the first section of the valve housing.

23. The artificial lift system of claim 20, further comprising a conduit having a first end and a second end, the first end in fluid communication with a source of the first fluid and the second end in fluid communication with the first reservoir of the piston.

24. A method of sealing an annulus space within a tubular of an artificial lift well installation, the method comprising the step of;

installing a subsurface safety valve, the subsurface safety valve positioned between the first end and the second end of the pump shaft and forming a section thereof, the subsurface safety valve being operable between an open condition wherein the annulus space is not sealed by the subsurface safety valve and a sealed condition wherein the annulus space is sealed by the subsurface safety valve, the subsurface safety valve comprising;

(i) a valve housing having a first section and a second section, the first section having a hollow cylinder for receiving a piston, the hollow cylinder having a first portion, a second portion and a first circumferential ledge;

(ii) a piston positioned within the hollow cylinder, the piston having a first end, a second end, a first radially extending circumferential land positioned therebetween, and the piston and the valve housing providing a first reservoir within the first section of the valve housing for receiving a first fluid and the piston and the valve housing providing a second reservoir within the second section of the valve housing for receiving a second fluid;

(iii) a biasing element to assist in operably placing the valve in the sealed condition, the biasing element positioned between the first circumferential ledge of the hollow cylinder and the first radially extending circumferential land, the biasing element providing a biasing force within the valve housing to assist in placing the valve in the sealed condition; and (iv) a sealing member for selectively sealing the annulus space when a hydraulic force is exerted thereupon; and applying hydraulic pressure to at least one of the first fluid and the second fluid, the hydraulic pressure applied to a valve opening pressure that overcomes the biasing force and maintains the valve in a normally open condition, wherein altering the valve opening pressure operably enables the biasing force to place the valve in the sealed condition.

25. The method of claim 24, wherein the piston has at least one orifice for placing the first reservoir in fluid communication with the first portion of the hollow cylinder.

26. The method of claim 25, wherein a second circumferential ledge is positioned between the first portion and the second portion of the hollow cylinder.

27. The method of claim 26, wherein the second portion of the hollow cylinder of the valve housing defines a second reservoir.

28. The method of claim 27, wherein the piston includes a second radially extending circumferential land positioned adjacent the second end of the piston and within the second portion of the hollow cylinder of the valve housing.

29. The method of claim 28, wherein the safety valve is held in an open position by filling the first reservoir of the piston and the first portion of the hollow cylinder of the valve housing with the first fluid and pressurizing the first fluid to a level sufficient to overcome the force exerted by the biasing element.

30. The method of claim 29, wherein the second reservoir contains a second fluid and is structured and arranged to enable the sealing member to be extended into sealing engagement with the tubular upon the urging away of the piston from the first circumferential ledge of the hollow cylinder by the biasing element when the pressure of the first fluid becomes insufficient to overcome the force exerted by the biasing element.

31. The method of claim 29, wherein the sealing member comprises a bladder having a first end and a second end, the first end affixed to the first section of the valve housing and the second end affixed to the second section of the valve housing.

32. The method of claim 29, wherein the sealing member is in the form of an umbrella, the umbrella having a first end affixed to the first section of the valve housing.

33. The method of claim 29, wherein the subsurface safety valve further includes a conduit having a first end and a second end, the first end in fluid communication with a source of the first fluid and the second end in fluid communication with the first reservoir of the piston.

34. The method of claim 29, wherein the valve housing is positioned within a section of a rotatable downhole pump shaft.

35. The method of claim 29, wherein the valve housing is positioned within a section of a tubular.

36. A method of sealing an annulus within a tubular of an artificial lift well, the artificial lift well comprising a pump motor positioned adjacent the wellhead, the pump motor having a rotatable pump shaft connected thereto and extending into the artificial lift well, the method comprising the steps of:

terminating the rotation of the rotatable pump shaft; and biasing a piston to displace the piston and exert a force sufficient to initiate the transfer of a predetermined amount of fluid to an annulus sealing member to expand the sealing member of a subsurface safety valve to seal the annulus about the rotatable pump shaft.

37. The method of claim 36, wherein the step of terminating the rotation of the rotatable pump shaft further comprises providing a signal to the pump motor responsive to an emergent condition.

38. The method of claim 37, wherein the pump motor includes a control sensor and the step of providing a signal further comprises sensing a reduction in hydraulic pressure.

* * * * *